US005747781A

United States Patent [19]

Kim et al.

[11] Patent Number: 5,747,781

[45] Date of Patent: May 5, 1998

[54] MICROWAVE OVEN WITH TURNTABLE AND SWINGABLE ELECTRICAL HEATER

[75] Inventors: Byeong-Jun Kim; Jae-Soo Kim; Sang-Kee Min; Byung-Nam Choi; Hyung-Ki Park, all of Incheon, Rep. of Korea

[73] Assignee: Daewoo Electronics Co., Ltd., Seoul, Rep. of Korea

[21] Appl. No.: 755,610

[22] Filed: Nov. 25, 1996

[30] Foreign Application Priority Data

Dec. 22, 1995 [KR] Rep. of Korea ..... 95-54258

[51] Int. Cl.[6] ..... H05B 6/78; F24C 7/02

[52] U.S. Cl. ..... 219/685; 219/404; 219/754

[58] Field of Search ..... 219/685, 754, 219/756, 404

[56] References Cited

U.S. PATENT DOCUMENTS

| | | | |
|---|---|---|---|
| 4,326,113 | 4/1982 | Toyoda et al. | 219/754 |
| 4,629,850 | 12/1986 | Tanabe | 219/685 |
| 4,745,246 | 5/1988 | Hori et al. | 219/685 |
| 5,534,681 | 7/1996 | Hwang | 219/685 |
| 5,548,102 | 8/1996 | Kwon | 219/685 |

FOREIGN PATENT DOCUMENTS

| | | | |
|---|---|---|---|
| 37 23 628 | 1/1989 | Germany | 219/685 |
| 40 04 130 | 8/1991 | Germany | 219/685 |
| 52-76746 | 6/1977 | Japan | 219/685 |
| 53-112538 | 10/1978 | Japan | 219/685 |

*Primary Examiner*—Philip H. Leung

*Attorney, Agent, or Firm*—Beveridge, DeGrandi, Weilacher & Young LLP

[57] ABSTRACT

A microwave oven having a heater apparatus has an upper heater installed to an upper portion of a cooking chamber for transmitting heat toward the center of the cooking chamber. A bracket is fixed to a side plate of the cooking chamber and has a pair of lugs spaced apart from each other by roughly 60° along the swinging direction of the upper heater. A bushing is fitted into the bracket to be rotatable therein, and is pierced with the upper heater along the rotating shaft line. A guiding plate formed with a groove is fixed to the bushing. A lower heater is installed to a bottom plate of the cooking chamber to be shaped as an alphabet "U," and a turntable is coated with a ceramic. Thus, the swinging angle of the upper heater is controlled to adjust a distance from food, and the upper plate of the cooking chamber is cleaned by easily swinging the upper heater. The lower heater bakes the lower side of food to consistently cook the food.

3 Claims, 6 Drawing Sheets

MICROWAVE OVEN WITH TURNTABLE AND SWINGABLE ELECTRICAL HEATER

BACKGROUND OF THE INVENTION

1. Field of the Invention

The present invention relates to a microwave oven with turnable and swingable electrical heater, and more particularly to a microwave oven with turntable and swingable electrical heater wherein an upper heater capable of swinging is installed to the upper portion of a cooking chamber, and a lower heater is installed to the lower portion of the cooking chamber to be operable selectively or simultaneously with a magnetron.

2. Description of the Prior Art

FIG. 1 is a diagrammatic section view showing a conventional microwave oven. As shown in FIG. 1, the conventional microwave oven is installed with a high pressure transformer 14 for generating a high voltage within a main body 10 shaped as a regular hexahedron, a magnetron 16 for oscillating high frequencies, and a cooling fan 19 for cooling down high pressure transformer 14 and magnetron 16.

A cooking chamber 11 within main body 10 is a space for heating food and the like, in which a heater 13 is fixedly installed to the upper portion thereof, and a turntable 3 for putting food and the like thereon is installed to the lower portion thereof. A motor 1 for rotating turntable 3 is buriedly installed to a bottom plate 5 at the lower portion of turntable 3.

A hot wind heater 7 is installed to the rear plate of cooking chamber 11. A heater (not shown) and a blower fan (not shown) are installed to the interior of hot wind heater 7, and a plurality of hot-wind circulating holes 9 are perforated into the surface of hot wind heater 7 for promoting air circulation throughout cooking chamber 11.

Meantime, since a temperature of cooking chamber 11 is dropped when air utilized for hot wind heater 7 is externally admitted, a damper 17 and an intake hole 18 are separately installed to the side plate of cooking chamber 11 for preventing the drop in the temperature. That is, damper 17 is opened to let the air within cooking chamber 11 to flow toward hot wind heater 7.

The conventional microwave oven having the above-described construction can be classified into a oven cooking system, a grill cooking system and a convection cooking system in accordance with the cooking way.

The oven cooking system is of solely employing magnetron 16, in which high frequencies directly infiltrate through the inside of food to prepare the dish.

The grill cooking system utilizes heater 13 and hot wind heater 7 without employing the magnetron. While hot wind heater 7 is operated, the air within cooking chamber 11 passes through hot wind heater 7 by means of the blower fan. At this time, the air is changed into hot wind to be supplied to the food within cooking chamber 11 via hot-wind circulating holes 9. That is, the food is prepared by the hot wind and the heat supplied from heater 13.

The convection cooking system is of simultaneously employing magnetron 16, heater 13 and hot wind heater 7.

The conventional microwave oven having the above-described construction, however, involves problems as below.

In case of the grill cooking system, the food is prepared by heater 13 and the hot wind. Thus, the lower side of the food is not cooked. In more detail, since heater 13 is fixed to the upper portion of the food and the hot wind hardly infiltrates into the inside of the food, the food is locally heated at the surface and upper portion thereof. Consequently, the portion of the food in contact with turntable 3 is cooked late to be detrimental to consistently cooking overall food.

In regard to the convection cooking system, the hot wind produced from hot wind heater 7 is insufficiently supplied to the narrow space between turntable 3 and bottom plate 5. For this reason, there was a drawback of rarely cooking the bottom sides of bread and cookies toasted by the hot wind. To solve this drawback, a technique for consistently cooking the food has suggested that the food is turned over once during preparing the food or a gridiron and so forth fixed with the food is rotated. However, this technique involves a troublesome job of turning over the food at the appropriate moment. Furthermore, the internal temperature of the cooking chamber is so high to be dangerous. In addition to these, the structure for rotating the gridiron is complicated.

Heater 13 is fixed to the upper portion of cooking chamber 11 to make the cleaning thereof bothersome. In other words, when being stained with oil pertaining to the food or being smoke-stained during the cooking procedure, it is difficult to clean the upper plate of the cooking chamber due to heater 13 fixed, thus being unhealthy.

Also, if the food is short, the interval between heater 13 and the food is widened to require much more caloric capacity which is inefficient.

Further to these, there is a problem of increasing an installation space due to the fact that the space for being installed with hot wind heater 7 is required in the rear portion of the cooking chamber.

SUMMARY OF THE INVENTION

The present invention is devised to solve the foregoing problems. Therefore, it is an object of the present invention to provide a microwave oven with turntable and swingable electrical heater of a simple structure by installing a first heating section to the upper portion of a cooking chamber to heat the upper portion of food, and a second heating section to the lower portion of the cooking chamber to heat the lower side of the food put on a turntable.

It is another object of the present invention to provide a microwave oven with turntable and swingable electrical heater, wherein a first heating section swings to facilitate cleaning of the upper plate of a cooking chamber and to adjust an interval between food and the heater, thereby being capable of preparing the food while requiring low caloric capacity.

To achieve the above object of the present invention, there is provided a microwave oven with turntable and swingable electrical heater which includes a first heating section installed to an upper portion of a cooking chamber for transmitting heat toward the center of the cooking chamber, and a swinging section for swinging the first heating section within a range of a predetermined angle. Also, a second heating section is installed to a bottom plate of the cooking chamber for transmitting heat to a turntable installed to an interior of the cooking chamber.

Preferably, the first heating section is an upper heater, and the swinging section is fixed to a side plate of the cooking chamber.

Here, the swinging section includes a bracket fixed to the side plate and formed with at least one lug to a predetermined position. In addition, a bushing fitted into the bracket for being rotatable therein is received with the first heating section piercing therethrough along a rotating shaft line, and a guiding plate which is fixed to one plane of the bushing for being rotatable with the bushing is formed with a groove in an area corresponding to the lug.

It is preferable that the lug numbers a pair of lugs spaced apart from each other by as many as a predetermined angle along the swinging direction of the bushing. More preferably, the pair of lugs are spaced from each other by as many as approximately 60°.

Furthermore, the second heating section is preferably a lower heater installed to a lower plane of the bottom plate of the cooking chamber, which may be installed to be shaped as an alphabet "U."

Preferably, the bottom plate is formed with a plurality of heat-radiating holes in an area corresponding to the lower heater, and the surface of the turntable is coated with a ceramic for radiating far infrared rays.

Also, the ceiling plate and rear plate of the cooking chamber are respectively installed with a thermal insulation layer.

Alternatively, a microwave oven with turntable and swingable electrical heater includes an upper heater installed to an upper portion of a cooking chamber for transmitting heat toward the center of the cooking chamber, and a bracket fixed to a side plate of the cooking chamber to be formed with a pair of lugs spaced apart from each other by as many as approximately 60° along the swinging direction of the upper heater. Additionally, a bushing which is fitted into the bracket for being rotatable therein is received with the upper heater piercing therethrough along a rotating shaft line, and a guiding plate fixed to one plane of the bushing for being rotatable with the bushing is formed with a groove in an area corresponding to the lugs. A lower heater installed to a lower plane of a bottom plate of the cooking chamber formed with a plurality of heat-radiating holes is shaped as an alphabet "U" for transmitting the heat to a turntable installed within the cooking chamber, and a ceramic coating covers the surface of the turntable for radiating far infrared rays. Thermal insulation layers are installed to the ceiling plate and rear plate of the cooking chamber.

The microwave oven with turntable and swingable electrical heater constructed as above according to the present invention is operated as follows.

When conducting an oven cooking, the magnetron is operated to allow the high frequencies to oscillate to the interior of the cooking chamber. The oscillated high frequencies infiltrate through the food to promote the molecular motion to heat and cook the food. At this time, the food is rotated while the turntable is rotated by the driving of the motor, so that the food is consistently cooked.

In case of conducting a grill cooking, the upper heater being the first heating section is operated to heat the upper portion of the food. When the food is short, the upper heat swings as many as an angle of several degrees to adjust the distance between the upper heater and food. At this time, by operating the lower heater being the second heating section, the lower surface of the turntable is heated via the plurality of heat-radiating holes. Since the turntable is rotated by the driving of the motor, the lower side of the food is consistently heated and cooked.

On the other hand, once the turntable is heated by the heat generation of the lower heater, the ceramic coating covering the surface thereof is heated altogether to radiate the far infrared rays. At this time, the emitted far infrared rays penetrate into the food to function by enhancing the cooking state of the food.

If it is intended to clean the interior of the cooking chamber, the upper heater swings to be distanced from the upper plate of the cooking chamber. By doing so, the upper plate of the cooking chamber can be easily cleaned.

The microwave oven with turntable and swingable electrical heater as described above can heat even the lower side of the food to be useful for consistently cooking the food. Also, the swinging angle of the upper heater is controlled for adjusting the interval with to the food to allow for conducting the cooking with the slight caloric capacity, thereby heightening the thermal efficiency of the microwave oven. By easily and simply swinging the upper heater, the upper plate of the cooking chamber can be cleaned. Therefore, the interior of the cooking chamber is easily cleaned to be hygienic. Furthermore, no space for being installed with a hot wind heater is required to decrease the size of the microwave oven, which is in turn effective in economizing the installation space.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A preferred embodiment of a microwave oven with turntable and swingable electrical heater according to the present invention will be described in detail with reference to accompanying drawings.

Figure 1:
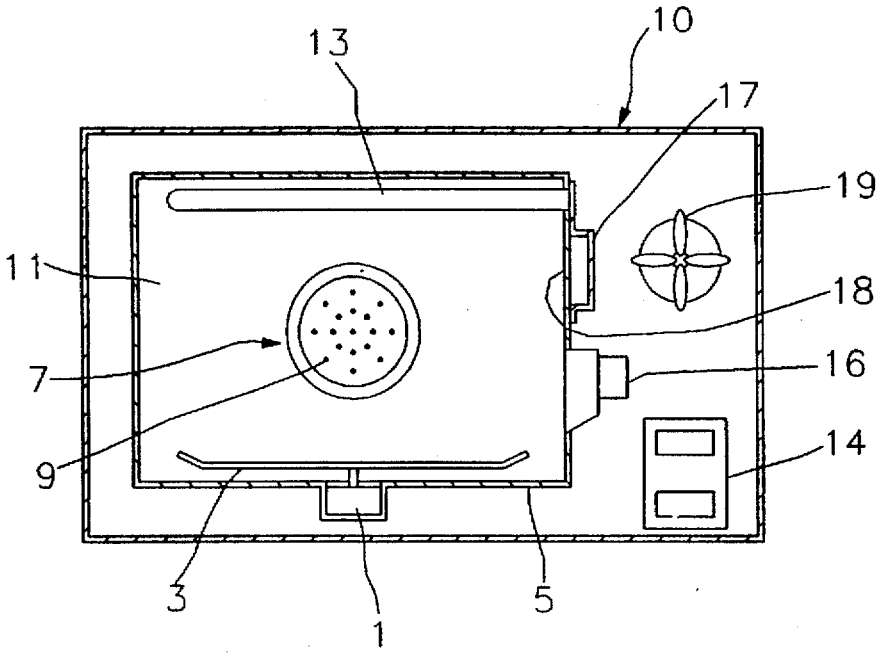
FIG. 1 PRIOR ART
FIG. 1 is a diagrammatic front view showing a conventional microwave oven with parts in section.
Figure 2A:
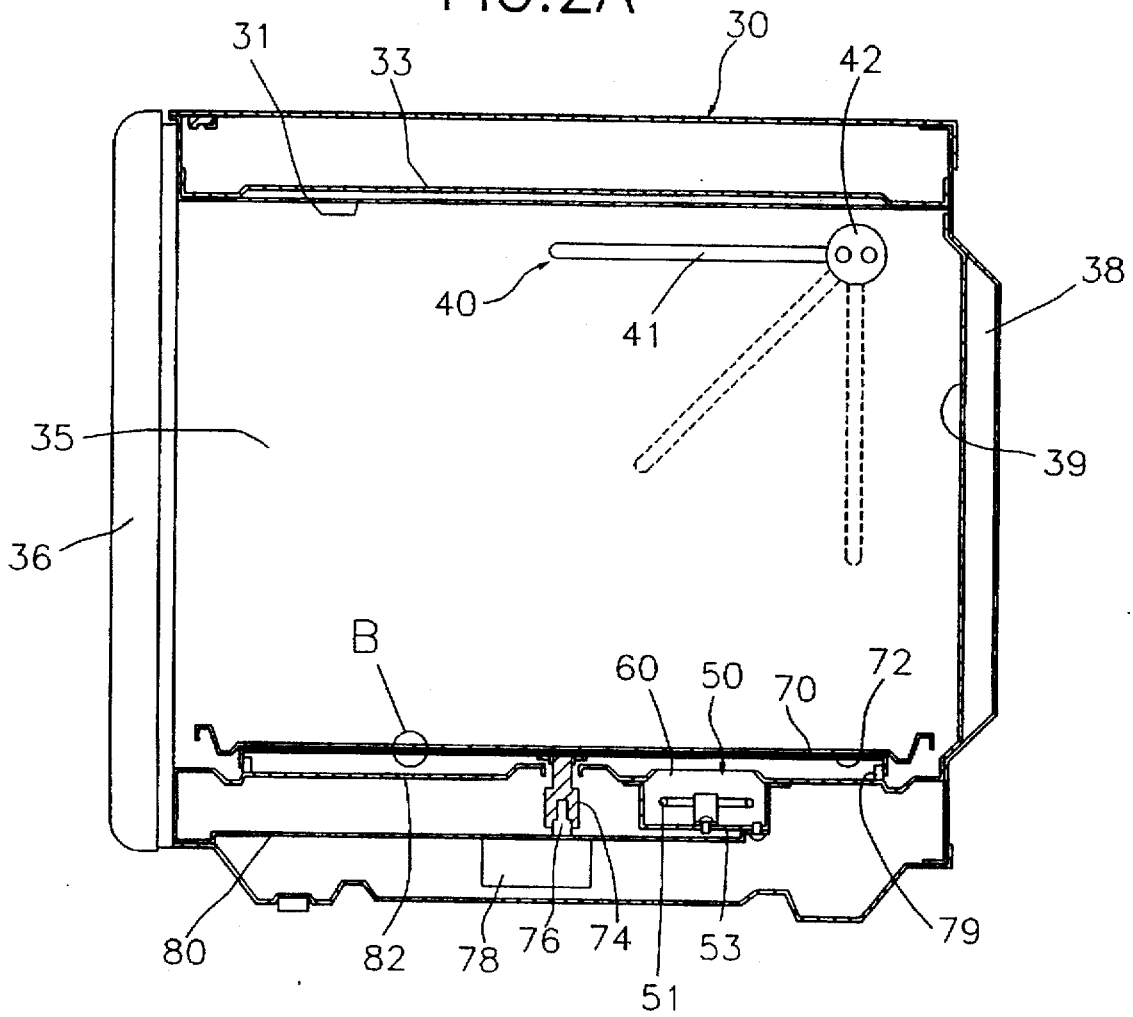
FIG. 2A is a diagrammatic side view showing a microwave oven with turntable and swingable electrical heater according to the present invention with parts in section.

FIG. 2A is a side section view diagrammatically showing the microwave oven with turntable and swingable electrical heater according to the present invention. As shown in FIG. 2A, the microwave oven is formed by a main body 30, a first heating section 40, a second heating section 50, a turntable 70, etc.

Main body 30 is shaped as a regular hexahedron and is installed with a door 36 at the front side thereof. A cooking chamber 35 is provided within main body 30. A ceiling plate 31 is installed to the upper portion of the interior of cooking chamber 35, which is formed double to provide a thermal insulation layer 33. A rear plate 39 is installed to the rear side of cooking chamber 35, which is also formed by a double layer to form a thermal insulation layer 38. A bottom plate 82 is provided to the bottom side of cooking chamber 35, and is installed with turntable 70 and a lower heater 51 being second heating section 50.

Turntable 70 is shaped as a disc of which surface is covered with a ceramic coating capable of radiating far infrared rays. Turntable 70 is supported by a guide 72 which is rotatable over bottom plate 82 by means of three rollers 79. Guide 72 has a center connected with the upper end of an bearing 74 of which lower end is connected to a rotating shaft 76 of a motor 78. Here, motor 78 is supported by a motor-fixing bracket 80 fixed to main body 30.

A typical embodiment of first heating section 40 is an upper heater 41. One end of upper heater 41 is exposed to the interior of cooking chamber 35, and the other end thereof is fixed to a side plate 96 of cooking chamber 35 by a bushing 42. In FIG. 2A, a solid-lined portion denotes upper heater 41 in the balanced state, and dot-lined portions denote upper heater 41 in the swinging state position.

A typical embodiment of second heating section 50 is lower heater 51 which is embedded into one side of bearing 74 in bottom plate 82 of cooking chamber 35. A plurality of heat-radiating holes 60 are formed in bottom plate 82 of cooking chamber 35 corresponding to the upper portion of lower heater 51. A case 53 is installed with lower heater 51 which is fixed therein, and the outer portion thereof is fixed to bottom plate 82 of cooking chamber 35 and motor-fixing bracket 80.

Figure 2B:
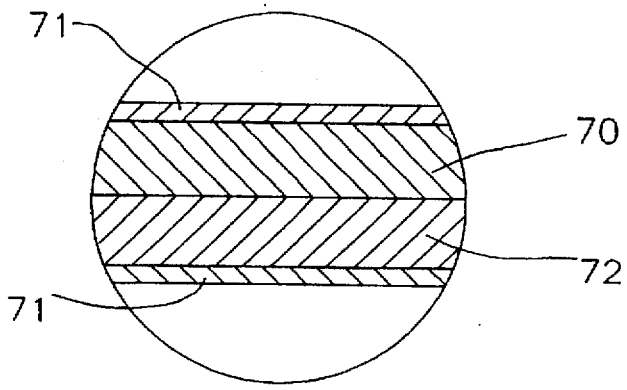
FIG. 2B is an enlarged section view showing the turntable and guide designated by an alphabet B in FIG. 2A.

FIG. 2B is an enlarged section view showing the turntable and guide designated by an alphabet B in FIG. 2A. As shown in FIG. 2B, guide 72 is seated with turntable 70 on the upper portion thereof, and the surfaces of turntable 70 and guide 72 are coated with a ceramic coating 71.

Figure 3:
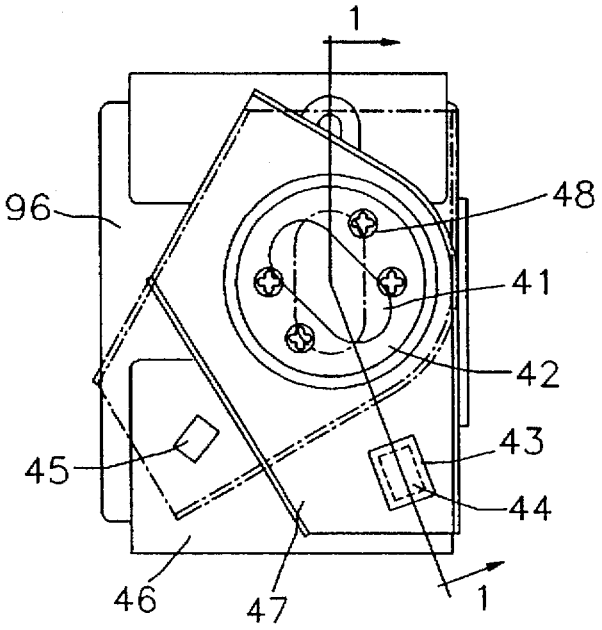
FIG. 3 is a front view showing the upper heater swinging section shown in FIG. 2A.

FIG. 3 is a front view showing the upper heater swinging section shown in FIG. 2A. Referring to FIG. 3, a bracket 46 is fixed to side plate 96 of cooking chamber 35. Bracket 46 is formed with a pair of projecting lugs 44 and 45. Lugs 44 and 45 are formed to be spaced apart from each other by as many as roughly 6° with respect to the swinging center of upper heater 41. The corner portions of lugs 44 and 45 are rounded off to be easily fitted into/separated from a groove 43. When the swinging position of upper heater 41 is needed to be adjusted by multiple phases, the number of lugs may be increased to be more than two.

A guiding plate 47 is installed to be rotatable by means of busing 42. Groove 43 is formed in an area of contacting lugs 44 and 45 for being fitted with lugs 44 and 45 in accordance with the swinging position of guiding plate 47.

Bushing 42 is installed to the swinging center of guiding plate 47, and bushing 42 and guiding plate 47 are connected by means of fixing screws 48. Upper heater 41 is installed to pierce through the central area of bushing 42.

Figure 4:
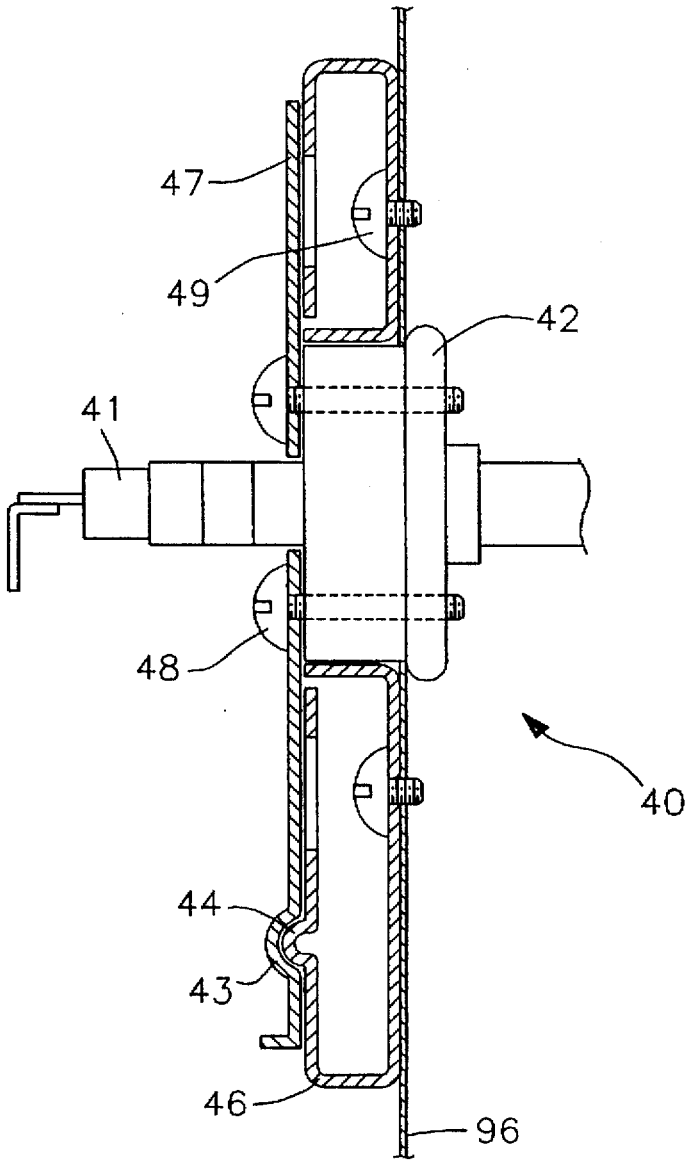
FIG. 4 is a sectional view, taken along line 1—1 in FIG. 3.

FIG. 4 is a sectional view, taken along line 1—1 in FIG. 3. As shown in FIG. 4, bracket 46 is fixed to side plate 96 of cooking chamber 35 by means of fixing screws 49. Lug 44 protrudes from the lower end of bracket 46.

Bushing 42 is installed to the center of bracket 46 by piercing through side plate 96 of cooking chamber 35 and bracket 46. Guiding plate 47 is installed to one side of bushing 42 by means of fixing screws 48. Upper heater 41 is installed to pierce through the center of bushing 42. That is, by the rotation of bushing 42, upper heater 41 and guiding plate 47 swing altogether.

Groove 43 is provided into guiding plate 47 of the portion corresponding to lug 44. Groove 43 is formed to be large enough to allow lug 44 to easily fit into/separate from groove 43.

Figure 5:
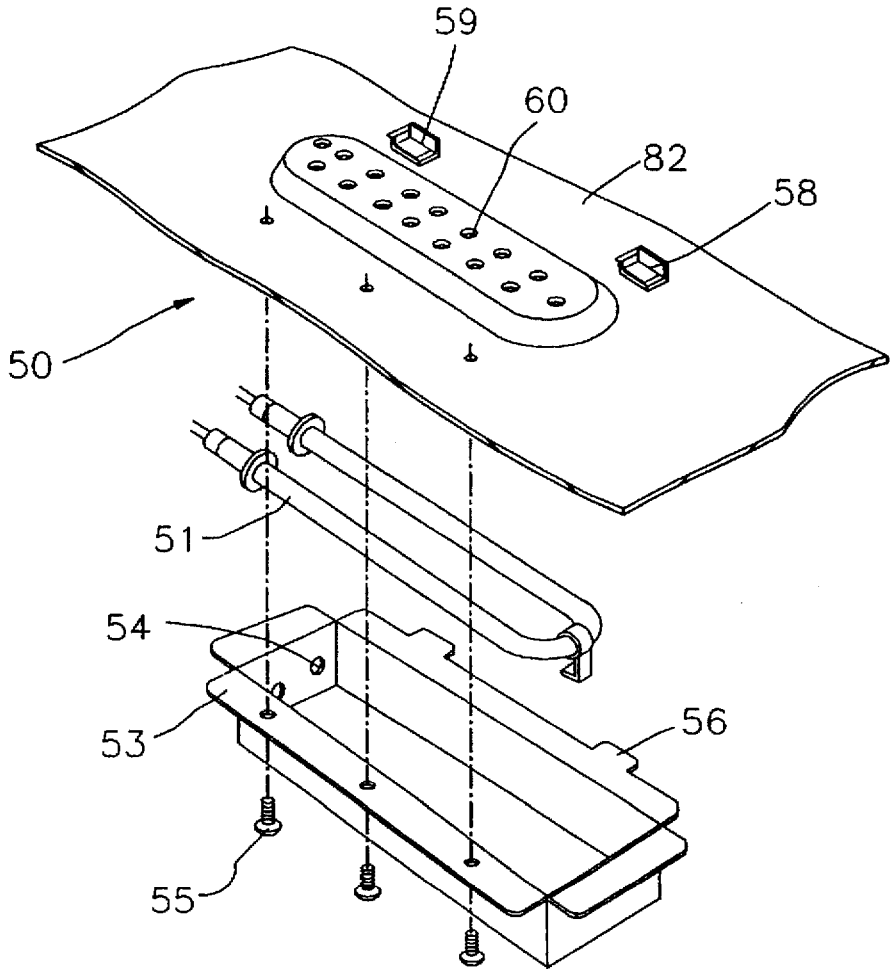
FIG. 5 is an exploded perspective view showing the lower heater according to the present invention.

FIG. 5 is an exploded perspective view showing the lower heater according to the present invention. Referring to FIG. 5, second heating section 50 is formed by bottom plate 82 of cooking chamber 35, lower heater 51 and case 53.

Plurality of heat-radiating holes 60 are formed in succession through bottom plate 82 of cooking chamber 35 by two rows. Three screw holes are formed into one side of heat-radiating holes 60, and two hooking jaws 58 and 59 are formed to the other side.

Case 53 is closely fixed to bottom plate 82 of cooking chamber 35 to prevent leakage of high frequencies. Three screws 55 are coupled into screw holes, and a hooking projections 56 are fitted into hooking jaws 58 and 59 to be fixed. A pair of apertures 54 are formed into one side of case 53 for receiving to be fixed with lower heater 51.

Lower heater 51 is fixed within case 53 while being bent to be shaped as an alphabet "U." Both ends of lower heater 51 are externally exposed via apertures 54 of case 53.

Figure 6:
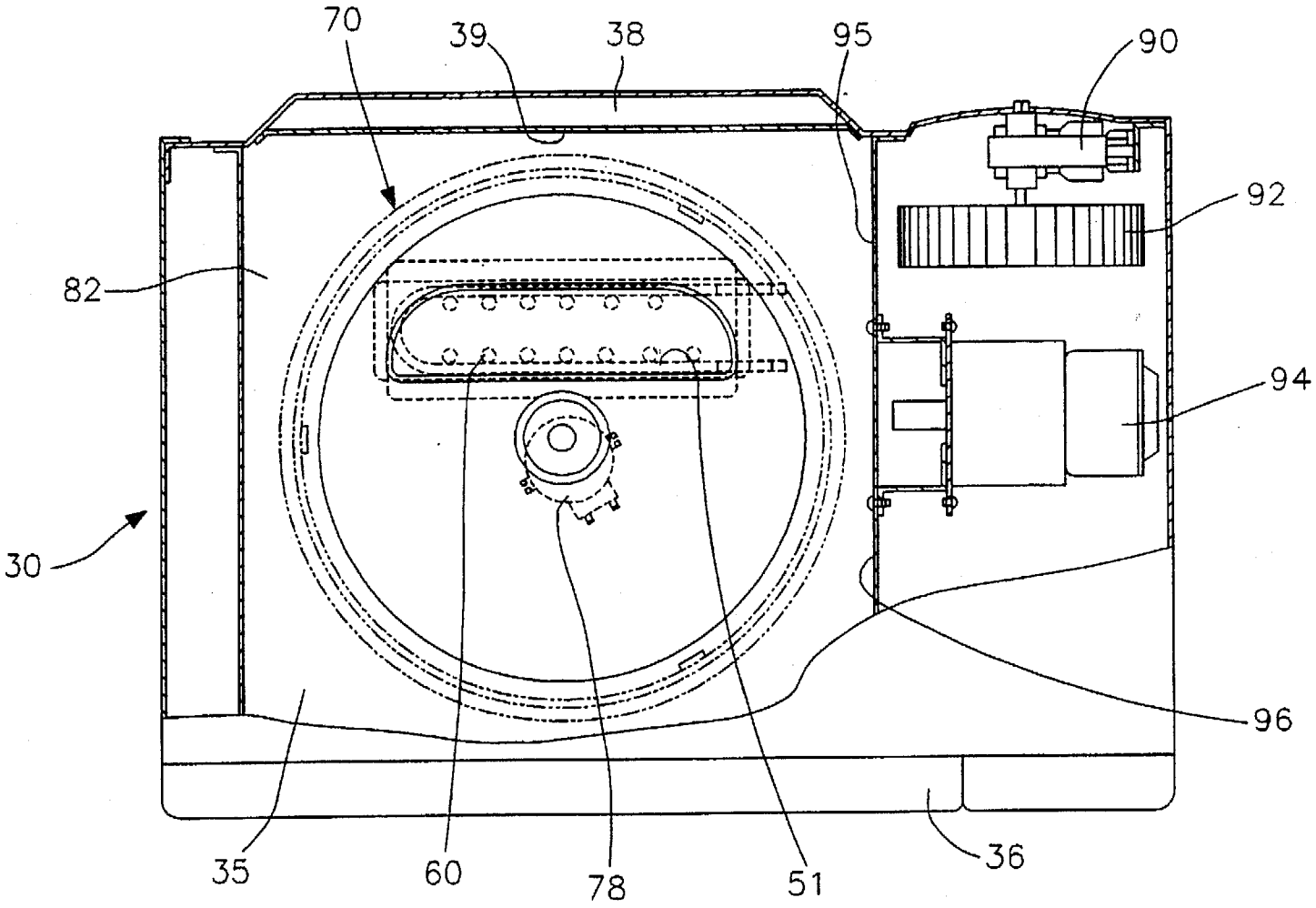
FIG. 6 is a diagrammatical plan view showing the microwave oven with turntable and swingable electrical heater according to the present invention with parts in section.

FIG. 6 is a diagrammatic plan view showing the microwave oven with turntable and swingable electrical heater according to the present invention with parts in section. As shown in FIG. 6, a magnetron 94, turntable 70, lower heater 51 and door 36 are installed to main body 30.

Turntable 70 is placed onto the center of cooking chamber 35, and motor 78 is installed to the center of turntable 70. Lower heater 51 is installed to one side of motor 78, and plurality of heat-radiating holes 60 are formed where lower heater 51 corresponds to bottom plate 82 of cooking chamber 35.

Thermal insulation layer 38 is formed to rear plate 39 of cooking chamber 35 to cut off the heat exchange with outside. Magnetron 94 is fixed to side plate 96 of cooking chamber 35, and motor 90 and a blower fan 92 are installed to face magnetron 94. A plurality of holes 95 are formed in side plate 96 of cooking chamber 35 adjacent to blower fan 92 for contriving the ventilation.

The microwave oven with turntable and swingable electrical heater having the above-described construction according to the present invention is operated and effected as below.

When the food is subjected to an oven cooking, the food is put on turntable 70, and door 36 is closed to shut off cooking chamber 35. Under this state, magnetron 94 is oscillated to force the high frequencies to infiltrate into the food. The high frequencies activate the molecular motion of the food to lead the food to generate heat, thereby preparing the food. Meantime, the driving of motor 78 is transferred to guide 72 via rotating shaft 76. Guide 72 rotates over bottom plate 82 of cooking chamber 35 by means of wheels 79. Turntable 70 is rotated together with guide 72 to permit the high frequencies to consistently radiate throughout the food.

When the food is subjected to the grill cooking, the food is put on turntable 70, and upper heater 41 swings by a predetermined angle. Upper heater 41 can swing in accordance with the height of the food at diverse angles. Then, bushing 42 and guiding plate 47 swing together with upper heater 41. By the frictional force between bushing 42 and bracket 46, upper heater 41 maintains the swinging position thereof. Thereafter, once door 36 is closed, cooking chamber 35 is shut off. Under this state, upper heater 41 and lower heater 51 are heated.

When upper heater 41 is operated to generate heat, the upper portion of cooking chamber 35 and the upper portion of the food are heated. Also, when lower heater 51 is operated to generate heat, the generated heat is transmitted to the interior of cooking chamber 35 via heat-radiating holes 60. The heat transmitted as above consistently heats the lower side of turntable 70. While turntable 70 is heated, the lower side of the food is heated, too.

With the operation of upper heater 41 and lower heater 51, the interior of cooking chamber 35 goes to the high temperature state. At this time, thermal insulation layers 33 and 38 serve for preventing external heat loss and enhancing thermal efficiency.

When the food is subjected to the convection cooking, magnetron 94, upper heater 41 and lower heater 51 are operated to consistently and simultaneously cook the upper and lower portions as well as the inside portion of the food. Depending on the kinds of food, the cooking state can be adapted by operating only magnetron 94 and upper heater 41 or selectively operating magnetron 94 and lower heater 51.

The sole operation of lower heater 51 indirectly heats the food by using turntable 70 to be effective in fermenting the food.

Once lower heater 51 is operated, the far infrared rays are radiated from ceramic coating 71 over the surface of turntable 70 while turntable 70 is heated. The radiated far infrared rays infiltrate through the food to improve the cooking status of the food and make the food be tasty.

The interior of cooking chamber 35 is intended to be cleaned, door 36 is opened to swing upper heater 41. Thus, guiding plate 47 swings to allow groove 43 to be fitted with lug 44. By doing so, upper heater 41 becomes distanced from ceiling plate 31 of cooking chamber 35. Consequently, a user can clean ceiling plate 31 of cooking chamber 35 without being interrupted by upper heater 41.

As a result, in the microwave oven with turntable and swingable electrical heater according to the present invention, the swinging angle of the upper heater is controlled to adjust the distance to the food. Due to this fact, the cooking is conducted with a slight caloric capacity to afford an advantage of raising the thermal efficiency of the microwave oven. Also, after the upper heater simply swings, the upper plate of the cooking chamber can be cleaned. Therefore, the interior of the cooking chamber is easily cleaned to be hygiene. The lower side of the food can be heated by the lower heater to consistently cook the food. Additionally, a space required for installing a hot wind heater is not required to be able to decrease the size of the microwave oven, which in turn economizes the installation space.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A microwave oven with turntable and swingable electrical heater comprising:

an upper heater installed to an upper portion of a cooking chamber located inside of the microwave oven for transmitting heat toward the center of said cooking chamber;

a bracket fixed to a side plate of said cooking chamber, and formed with a pair of lugs spaced apart from each other substantially 60° along the swinging direction of said upper heater;

a bushing fitted into said bracket for being rotatable therein, and being received with said upper heater piercing therethrough along a rotating shaft line;

a guiding plate fixed to one plane of said bushing for being rotatable with said bushing, and formed with a groove in an area corresponding to said lugs; and a lower heater installed to a lower plane of a bottom plate of said cooking chamber formed with a plurality of heat-radiating holes, and shaped as an alphabet "U" for transmitting the heat to a turnable installed within said cooking chamber.

2. The microwave oven with turntable and swingable electrical heater as claimed in claim 1, wherein said turntable further comprises a ceramic coating covering the surface of said turntable for radiating far infrared rays.

3. The microwave oven with turntable and swingable electrical heater as claimed in claim 1, wherein said cooking chamber further comprises thermal insulation layers installed to a ceiling plate and a rear plate of said cooking chamber.

* * * * *